US007197155B2

(12) United States Patent
Bank

(10) Patent No.: US 7,197,155 B2
(45) Date of Patent: Mar. 27, 2007

(54) MAGNET ASSEMBLY FOR LOUDSPEAKERS

(75) Inventor: Graham Bank, Suffolk (GB)

(73) Assignee: New Transducers Limited, Huntingdon (GB)

( * ) Notice: Subject to any disclaimer, the term of this patent is extended or adjusted under 35 U.S.C. 154(b) by 0 days.

(21) Appl. No.: 10/531,082

(22) PCT Filed: Oct. 9, 2003

(86) PCT No.: PCT/GB03/04385

§ 371 (c)(1),
(2), (4) Date: Oct. 7, 2005

(87) PCT Pub. No.: WO2004/034737

PCT Pub. Date: Apr. 22, 2004

(65) Prior Publication Data

US 2006/0165251 A1 Jul. 27, 2006

Related U.S. Application Data

(60) Provisional application No. 60/417,638, filed on Oct. 11, 2002.

(30) Foreign Application Priority Data

Oct. 10, 2002 (GB) ..... 0223654.5

(51) Int. Cl.
*H04R 25/00* (2006.01)

(52) U.S. Cl. ..... 381/420; 381/412; 381/414; 381/421

(58) Field of Classification Search ..... 381/412, 381/414, 419, 420, 421, 422, 189, 396; 310/13, 310/14, 15, 23; 318/135; 335/222
See application file for complete search history.

(56) References Cited

U.S. PATENT DOCUMENTS

| | | | | |
|---|---|---|---|---|
| 3,129,298 | A * | 4/1964 | Hofman | 381/189 |
| 3,549,830 | A | 12/1970 | Hofman | |
| 4,295,011 | A | 10/1981 | Hathaway | |
| 5,434,458 | A * | 7/1995 | Stuart et al. | 310/13 |
| 5,835,612 | A * | 11/1998 | Fujihira et al. | 381/421 |
| 6,020,805 | A | 2/2000 | Borja | |

FOREIGN PATENT DOCUMENTS

| | | |
|---|---|---|
| EP | 0 921 707 A2 | 6/1999 |
| GB | 543716 | 3/1942 |
| JP | 52-72216 | 6/1977 |
| SU | 711704 | 2/1974 |
| WO | WO 93/03586 A1 | 2/1993 |

* cited by examiner

*Primary Examiner*—Huyen Le
(74) *Attorney, Agent, or Firm*—Foley & Lardner LLP

(57) ABSTRACT

A magnet assembly having inner and outer yokes of magnetic flux conductive material which together define an annular air gap and a radially oriented magnet sandwiched between the inner and outer yokes such that a first face of a first magnetic polarity contacts the inner yoke and a second face of a second opposite magnetic polarity contacts the outer yoke, characterised by an axially oriented magnet forming part of the magnet assembly, and wherein the radially oriented magnet is annular and has opposed axial ends, and the inner and outer yokes are annular and together enclose one axial end of radially oriented magnet to define the air gap, and wherein the axially oriented magnet is disposed adjacent to the other axial end of the radially oriented magnet, whereby the inner and outer yokes and the axially oriented magnet together reduce flux leakage from the magnet assembly. From other aspects the invention is a moving coil actuator comprising the magnet assembly described above or a loudspeaker incorporating the actuator.

10 Claims, 7 Drawing Sheets

MAGNET ASSEMBLY FOR LOUDSPEAKERS

This application claims the benefit of U.S. provisional application No. 60/417,638, filed Oct. 11, 2002.

TECHNICAL FIELD

The invention relates to a magnet assembly, e.g. for an electromagnetic actuator, in particular a moving coil actuator or transducer. Such actuators are used, inter alia for driving loudspeakers.

BACKGROUND ART

A known typical voice coil actuator comprises a coil assembly and a magnet assembly. The magnet assembly comprises inner and outer yokes of magnetic flux conductive material which together define an air gap in which the coil assembly is suspended for movement within the air gap. A radially oriented magnet is sandwiched between the inner and outer yokes such that a first face of a first magnetic polarity is adjacent the inner yoke and a second face of a second opposite magnetic polarity is adjacent the outer yoke. For example, the use of a radially oriented magnet is shown in GB 670,027.

Such actuators may suffer from a large degree of flux leakage from the radial magnet. This makes the actuator unsuitable for some applications, particularly those in which the actuator is mounted close to a display used with a cathode ray tube. Furthermore, since a significant proportion of the magnetic flux is diverted from the air-gap, the magnet assembly size needs to be increased to ensure there is sufficient flux density in the air-gap to produce the necessary movement on the coil.

DISCLOSURE OF INVENTION

From one aspect the invention is a magnet assembly having inner and outer yokes of magnetic flux conductive material which together define an annular air gap and a radially oriented magnet sandwiched between the inner and outer yokes such that a first face of a first magnetic polarity contacts the inner yoke and a second face of a second opposite magnetic polarity contacts the outer yoke, characterised by an axially oriented magnet forming part of the magnet assembly, and wherein the radially oriented magnet is annular and has opposed axial ends, and the inner and outer yokes are annular and together enclose one axial end of radially oriented magnet to define the air gap, and wherein the axially oriented magnet is disposed adjacent to the other axial end of the radially oriented magnet, whereby the inner and outer yokes and the axially oriented magnet together reduce flux leakage from the magnet assembly.

The magnet assembly may comprise a shield mounted to the axially oriented magnet and to at least one of the inner and outer yokes to provide a path for magnetic flux to flow from the axially oriented magnet to the at least one yoke. In one embodiment, the axially oriented magnet contacts the inner yoke and the shield contacts the outer yoke. The shield may be cup shaped, and this may allow one of the yokes to be of reduced length. A second axially oriented magnet may be mounted at the opposed end of magnet assembly to the first axially oriented magnet.

The inner yoke may have a cross-section which tapers away from the air gap.

The inner and outer yokes may be provided with chamfers adjacent the air gap to focus the magnetic field developed within the gap.

The inner yoke may have a cross-sectional area compared to that of the outer yoke so that the volume of magnetic flux conductive material in both inner and outer yokes is approximately equal.

From another aspect the invention is an actuator comprising a coil assembly, a magnet assembly having inner and outer yokes of magnetic flux conductive material which together define an annular air gap in which the coil assembly is disposed, and a radially oriented magnet sandwiched between the inner and outer yokes such that a first face of a first magnetic polarity is adjacent the inner yoke and a second face of a second opposite magnetic polarity is adjacent the outer yoke, and a suspension connected between the coil assembly and the magnet assembly for supporting the coil assembly for axial movement within the air gap, characterised by an axially oriented magnet forming part of the magnet assembly, and wherein the radially oriented magnet is annular and has opposed axial ends, and the inner and outer yokes are annular and together enclose one axial end of radially oriented magnet to define the air gap, and wherein the axially oriented magnet is disposed adjacent to the other axial end of the radially oriented magnet, whereby the inner and outer yokes and the axially oriented magnet together reduce flux leakage from the magnet assembly.

From yet another aspect, the invention is a loudspeaker comprising an acoustic radiator and an actuator as described above which is mounted to the acoustic radiator to drive it to produce an acoustic output.

The actuator may be manufactured by adding the axially oriented magnet or magnets after the rest of the assembly is complete. The shield may be made by stamping and a recess may be formed in the outer yoke so that a corresponding protrusion on the shield may be located in the recess during manufacture. The radial magnet may consist of a number, e.g. four, radial segments. The components of the magnet assembly and of the actuator may be secured together by adhesive means.

BRIEF DESCRIPTION OF DRAWINGS

The invention is diagrammatically illustrated, by way of example, in the accompanying drawings in which.

BEST MODES FOR CARRYING OUT THE INVENTION

In each of the embodiments, the actuator is symmetrical about a central axis 16.

Figure 1:
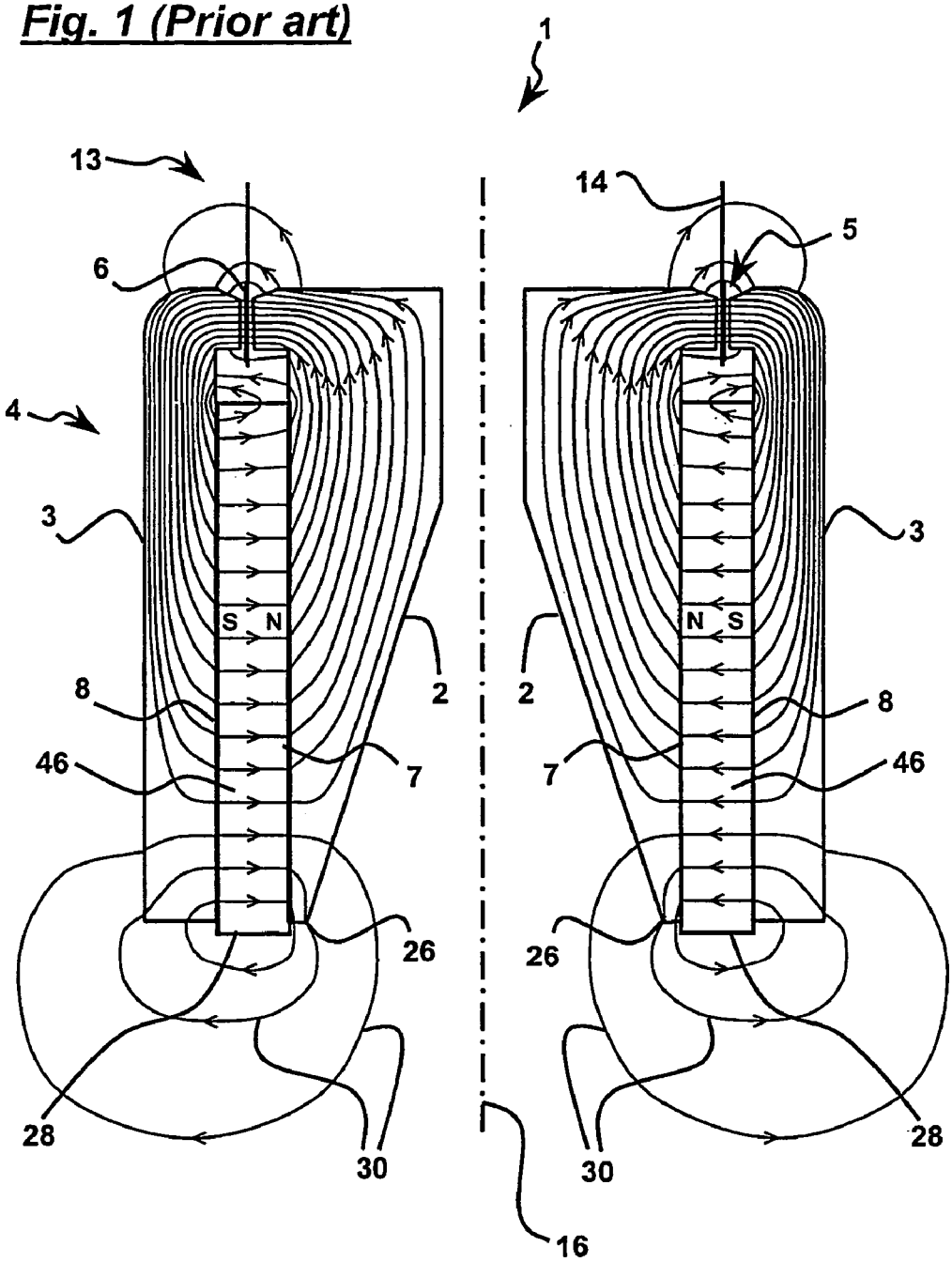
Fig. 1 (Prior art)
FIG. 1 is a cross-sectional view of a prior art actuator showing the flux contours of the magnetic field.

FIG. 1 shows a prior-art actuator 1 which comprises a magnet assembly having an inner yoke 2, an outer yoke 3, and an annular magnet 46 and a coil assembly 13 comprising an electrical current conductive coil 6 wound on a coil former 14. The inner yoke 2 and outer yoke 3 are constructed from magnetic flux conductive material (e.g. steel) and are generally annular. The inner and outer yokes 2,3 are mounted coaxially and are both centred on the central axis 16 of the actuator.

The magnet 46 is sandwiched between the inner yoke 2 and the outer yoke 3 which extend beyond the magnet 46 to define an annular air gap 5 between the inner and outer yokes 2,3. The magnet 46 is radially magnetised (oriented). Thus the magnet has a first face 7 of a first magnetic polarity e.g. N facing the inner yoke 2 and a second face 8 of a second, opposite magnetic polarity e.g. S facing the outer yoke 3. Flux lines 30 show the flux leakage from the base of the magnet assembly 4.

The inner yoke 2 has a cross-section which tapers to a small dimension 26 adjacent a base 28 of the magnet and away from the air gap 5. The coil 6 is moveably suspended in the gap such that an electrical current in the coil 6 develops a Lorentz force on the coil 6 in a direction substantially normal to the radial magnetic flux. The coil 6 is displaced in response to such magnetic force. There are various known means for suspending the coil 6 in the gap as exemplified below with reference to FIGS. 8 and 9.

Figure 2:
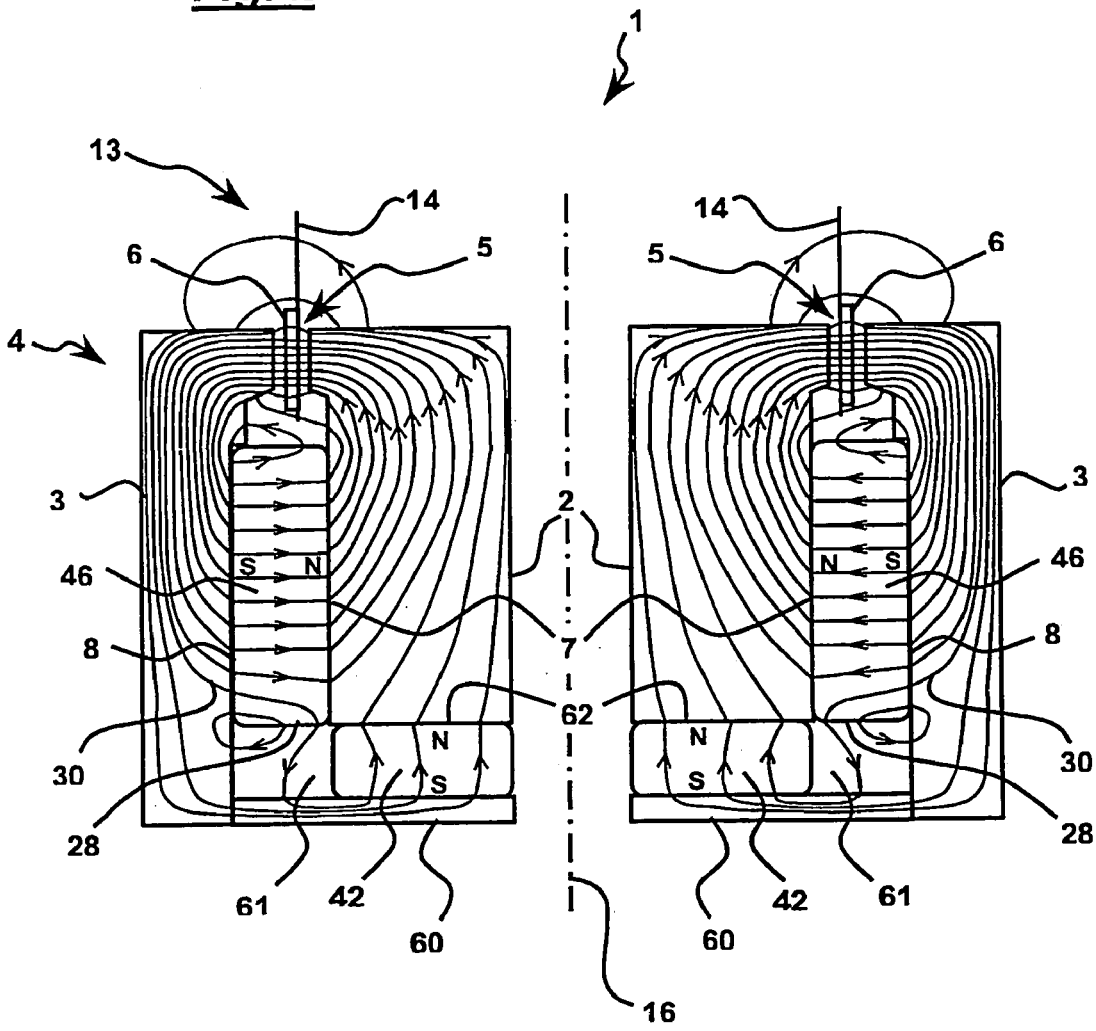
FIG. 2 is a cross-sectional view of a first embodiment of actuator according to the invention.
Figure 7A:
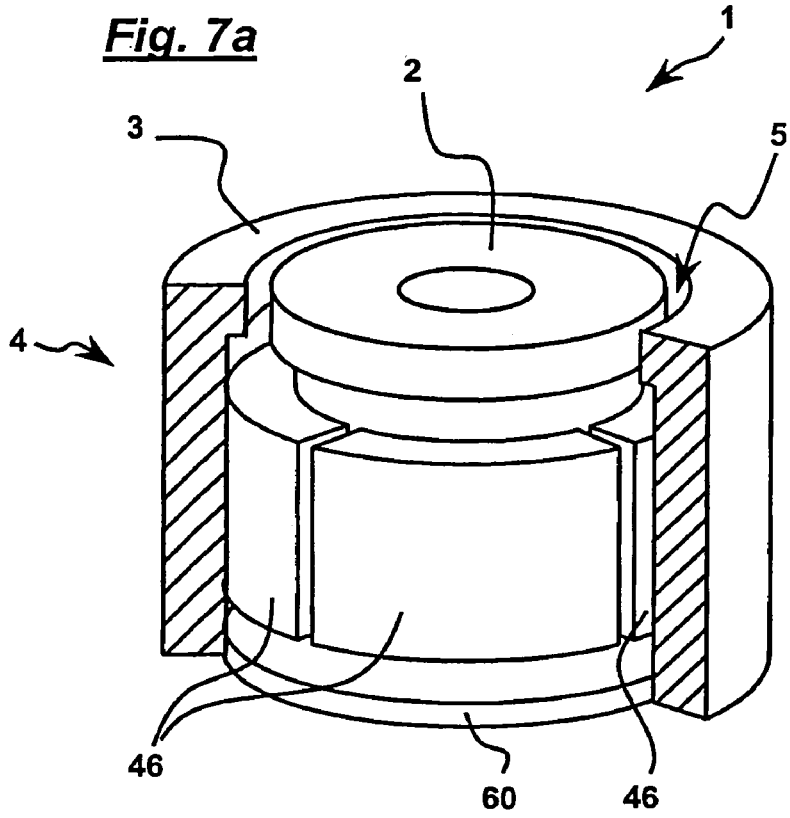
FIGS. 7*a* and 7*b* are respective partly sectioned perspective views of the actuator of FIG. 2.
Figure 7B:
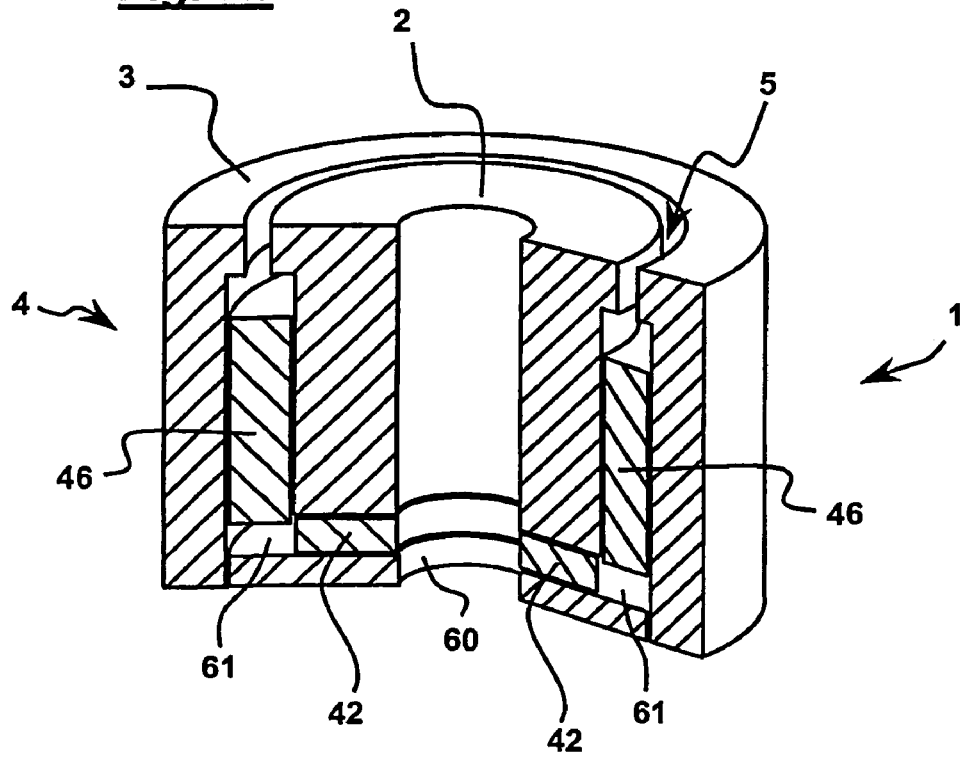

FIG. 2 together with FIGS. 7*a* and 7*b* show a first embodiment of actuator 1 of the present invention and which comprises a magnet assembly 4 having an inner annular yoke 2, an outer annular yoke 3, sandwiching an annular magnet 46 and a coil assembly 13 comprising an electrical current conductive coil 6 wound on a tubular coil former 14. The inner yoke 2 and outer yoke 3 are constructed from magnetic flux conductive material (e.g. steel) and are coaxial and are both centred on the central axis 16 of the actuator.

The magnet 46 is radially magnetised and is sandwiched between the inner yoke 2 and the outer yoke 3, and the yokes extend beyond the magnet 46 to define an annular air gap 5 between the inner and outer yokes 2, 3. Thus the magnet 46 has a first face 7 of a first magnetic polarity e.g. N facing the inner yoke 2 and a second face 8 of a second, opposite magnetic polarity e.g. S facing the outer yoke 3.

Unlike the prior art embodiment of FIG. 1, the inner yoke 2 has a constant cross section. The lower axial end or base 62 of the inner yoke 2 is arranged to lie flush with the corresponding lower axial end or base 28 of the radially oriented magnet 46, and an axially oriented annular magnet 42, having inner and outer diameters similar to those of the inner yoke 2 at its base 62, is mounted against the base 62 of the inner yoke 2.

An annular disc-like shield 60 of magnetic flux conductive material is mounted against the axial magnet 42 and abutting the lower axial end, as seen in FIG. 2, of the outer yoke 3, which is axially longer than the inner yoke. The inner diameter of the shield 60 is similar to that of the inner yoke 2 whereby the centre of the magnet assembly is vented. As will be seen by the flux lines in FIG. 2, the axial magnet 42 and the shield 60 together steer the magnetic flux at the base of the magnet assembly 4 to reduce or prevent flux leakage in comparison to the prior art actuator of FIG. 1.

The coil 6 is moveably suspended in the gap such that an electrical current in the coil 6 develops a Lorentz force on the coil 6 in a direction substantially normal to the radial magnetic flux. The coil 6 is displaced in response to such magnetic force. There are various known means for suspending the coil 6 in the gap, see, for example, FIGS. 8 and 9 below.

Notably, the actuator of FIGS. 2, 7*a*, 7*b* is made from simple components having minimum machining requirements. The inner and outer yokes 2, 3 are both generally cylindrical with no chamfers or rounded edges. The shield 60 is an annular disc which is the same width as and is attached to the outer yoke 3. There are no rounded edges on the shield 60 and the volume of the chamber 61 defined by the shield 60 is small. The radially oriented magnet 46 comprises four segments e.g. of Neodymium which are equally spaced around the inner yoke 2 and together form a generally cylindrical magnet. By simplifying the actuator design so that only simple turning of the metal parts is needed manufacturing complexity and cost may be reduced. The simplified design has the same magnetic strength and force in the air gap as the unshielded prior art embodiment of FIG. 1 but a 35% reduction in the radially oriented magnet volume and a 5% reduction in weight.

Figure 3:
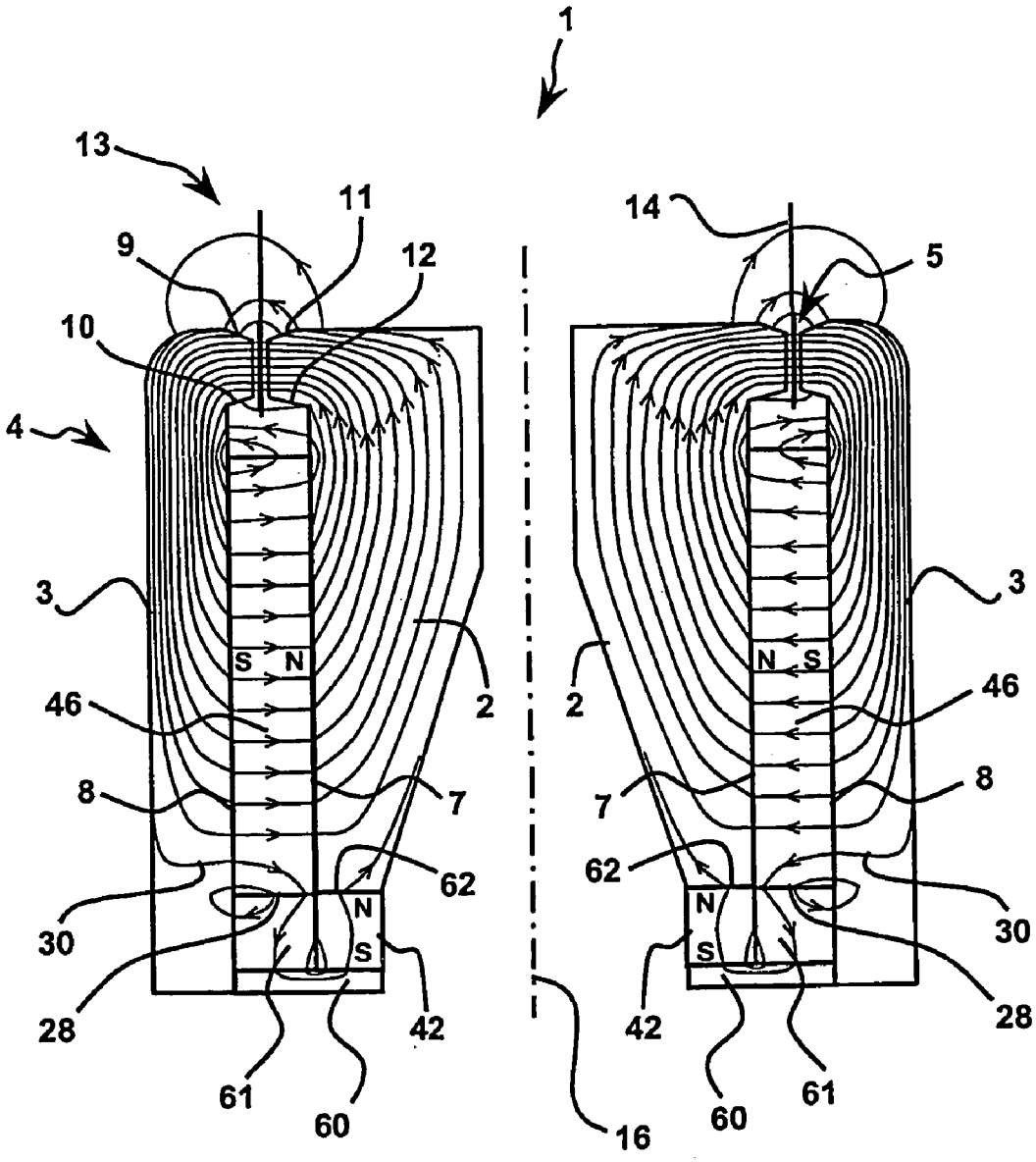
FIG. 3 is a cross-sectional view of a second embodiment of actuator according to the invention.

FIG. 3 shows an actuator according to the present invention which is very similar to that of FIG. 2 but in which the inner yoke tapers away from the air gap.

As shown in FIG. 3, the axially oriented magnet 42 steers the magnetic flux from the base 28 of the radially oriented magnet 46 towards the voice coil 6 in the air gap. Thus, the axially oriented magnet 42 may be considered to be a steering magnet and although the magnet 46 has been shortened, there is no loss in magnetic field strength in the air gap.

Figure 4:
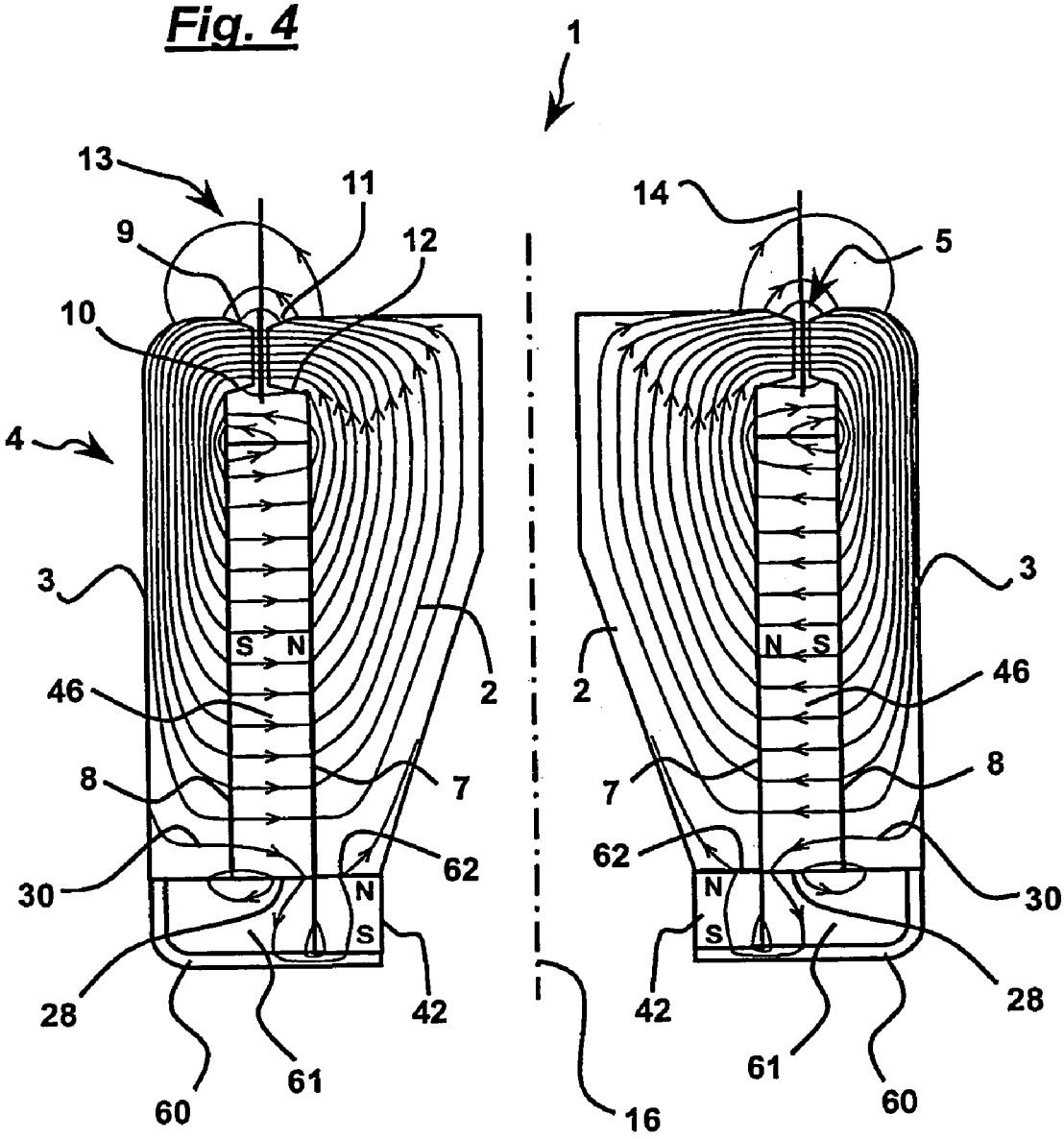
FIG. 4 is a cross-sectional view of a third embodiment of actuator of the invention.

FIG. 4 shows an actuator very similar to that of FIG. 3 but in which the inner and outer yokes 2,3 are of the same axial length. In this case, the shield 60 is in the form of an annular cup which is attached to the base of the axially oriented magnet 42 and to the base of the outer yoke 3 to define a hollow chamber 61 at the base of the outer yoke 3 and radially oriented magnet 46. In this way the overall weight of the magnet assembly may be reduced.

As in the previous embodiments, the axially oriented magnet 42 steers the magnetic flux from the base 62 of the inner yoke 2 towards the air gap. The shield 60 provides a route or return path for the magnetic flux to pass from the axial magnet 42 to the outer yoke 3. This increases the steering of the magnetic field produced by the axially oriented magnet 42.

Values of the magnetic field strength B1 (Tm), the nominal force and $B1^2/Re$ (Ns/m) may be calculated or estimated for actuators using standard techniques and are set out below. For the calculations, the coil 6 has 82 turns and 16 ohm resistance:

| | Nominal force (N) | estimated Bl (Tm) | Bl^2/Re (Ns/m) |
|---|---|---|---|
| FIG. 1 embodiment | 0.662 | 10.59 | 7.0 |
| FIG. 4 embodiment | 0.638 | 10.21 | 6.51 |

Thus, both embodiments have comparable values of magnetic field strength and nominal force in the air gap.

In both the embodiments of FIGS. 3 and 4, the overall length and weight of the actuator is approximately equal to that of the corresponding actuator of FIG. 1. Although the length of the main radially oriented magnet has been reduced, a similar level of magnetic field strength is achieved at the drive point, i.e. in the air gap. In both embodiments the flux leakage is reduced and thus a more efficient actuator is provided.

In both of the FIG. 3 and 4 embodiments, adjacent the air gap, the inner yoke 2 is provided with chamfers 9,10 and the outer yoke 3 is provided with chamfers 11,12 to focus the magnetic field developed by the radially oriented magnet within the gap. Thus, a more efficient magnet structure may be created. The angle of chamfering of upper and lower edges of the magnetic air gap 5 causes any flux vectors which are generated to be additive and focused in a radial direction.

Figure 5:
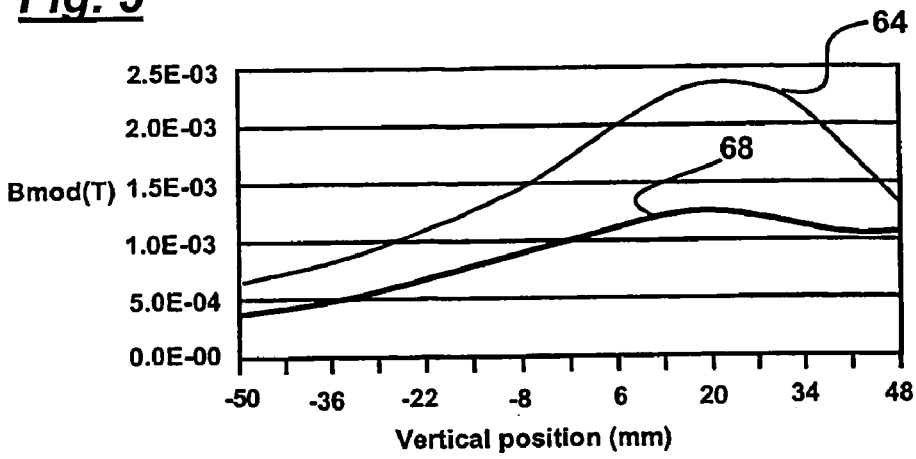
FIG. 5 is a graph comparing the modulus of the magnetic field strength Bmod against vertical position for the actuators of FIGS. 1 and 3.

The flux leakage of a prior art transducer and a transducer according to the invention is compared in FIG. 5. In FIG. 5, the modulus of the magnetic field strength (Bmod) is measured along a line which is parallel to and spaced at a distance of 50 mm from the axis of the actuator. The line extends through the actuator and about 50 mm in both directions outside the actuator. The thin line 64 shows the value of Bmod for the unshielded transducer and the thick line 68 the value for a transducer according to the present invention.

In FIG. 5, the magnetic field is more constant for the transducer according to the present invention showing that there is a significant reduction in the flux leakage. The stray field which produces the leakage is approximately halved in strength. However, there is a small reduction in the overall magnetic field strength.

Figure 6:
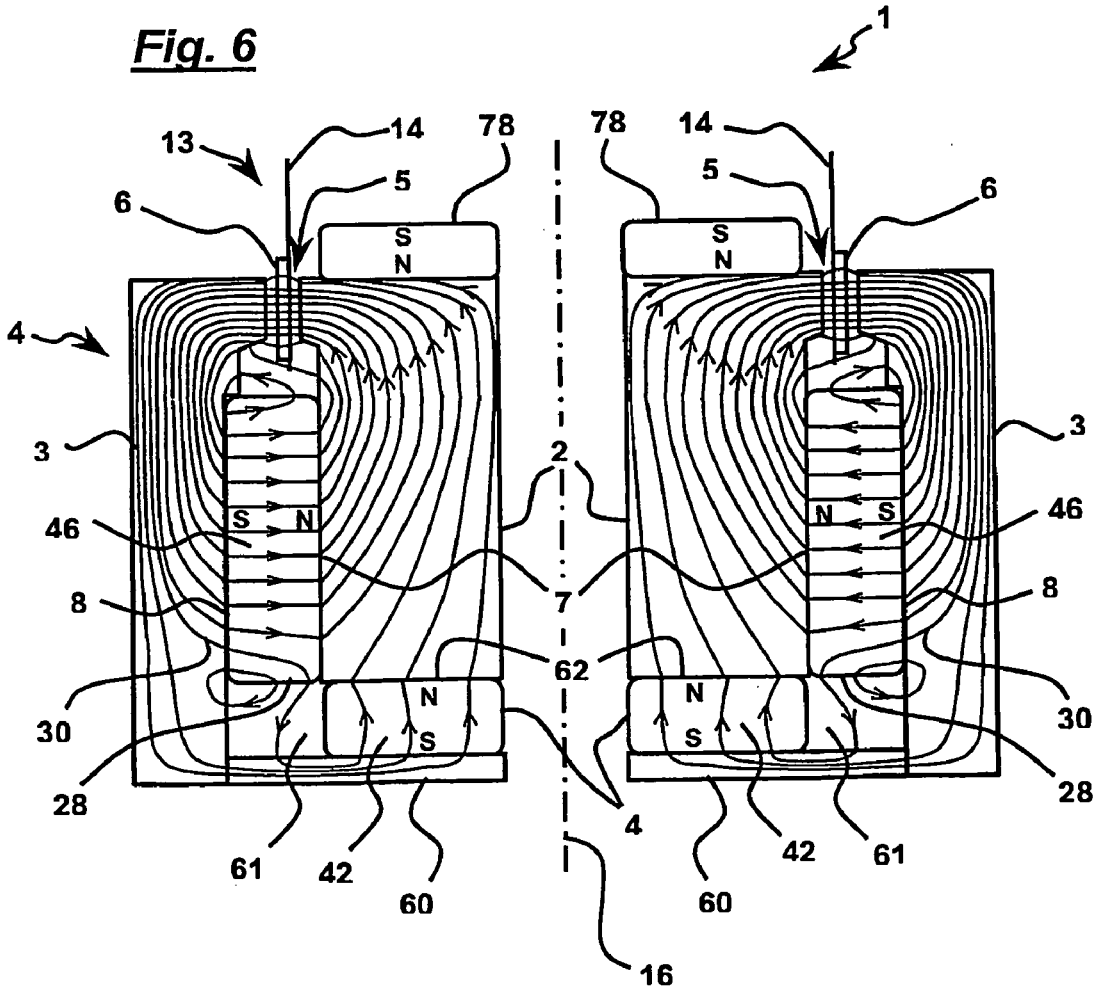
FIG. 6 is a cross-sectional view of a fourth embodiment of actuator according to the invention.

The actuator shown in FIG. 6 is very similar to that of FIG. 2 with the addition of a second axially oriented magnet 78 mounted on the opposed face of the inner yoke 2 to the first axially oriented magnet 42. Both magnets 42,78 are disc magnets. The second magnet 78 further helps to reduce the stray field whereby the flux lines are substantially contained within the complete magnet assembly. The second magnet 78 is sometimes known as a bucking magnet.

Figure 8:
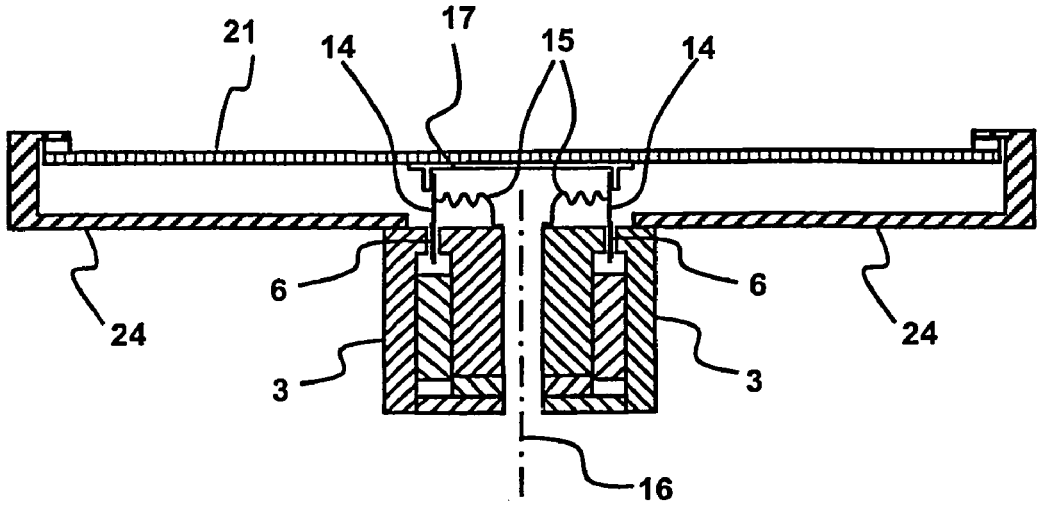
FIG. 8 is a cross-section of a bending wave panel-form loudspeaker comprising the actuator of FIG. 2.

FIG. 8 shows an application of the actuator 1 of FIG. 2 in a bending wave panel-form loudspeaker such as those taught in WO 97/09842 and known as distributed mode loudspeakers. The loudspeaker comprises an acoustic radiator in the form of a panel 21 which is mechanically connected to the coil former 14 through a lightweight plastics coupling ring 17. The panel 21 is supported in an enclosure 24. The outer yoke 3 is attached to a rear face 22 of the enclosure 24 whereby the actuator is grounded on the enclosure. A resilient suspension 15 is attached between the inner yoke 2 and the coil former 14 to suspend the coil 6 in its zero current bias position. The actuator axis 16 is marked.

Figure 9:
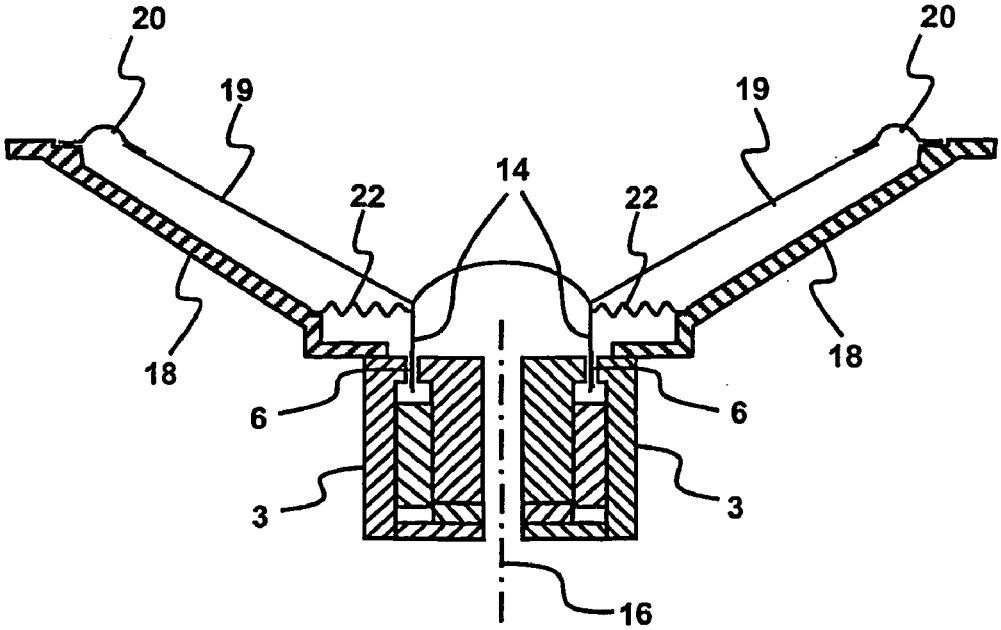
FIG. 9 is a cross-section of a pistonic cone loudspeaker comprising the actuator of FIG. 2.

FIG. 9 shows an application of the actuator 1 of FIG. 2 in a pistonic cone loudspeaker. The loudspeaker includes an acoustic radiator in the form of a cone 19 which is mechanically connected to the coil 6 and the coil former 14 by an adhesive connection. The cone 19 is supported in a chassis 18 by a resilient suspension surround 20. The actuator 1 is also grounded on the chassis 18 by attaching the outer yoke 3 to a rear face of the chassis. A resilient expandable suspension, known as a spider 22 is attached between the chassis 18 and the coil former 14 to suspend the coil 6 in its zero current bias position. The arrangement of the cone and both resilient suspensions is well known per se.

The invention claimed is:

1. A magnet assembly having inner and outer yokes of magnetic flux conductive material which together define an annular air gap and a radially oriented magnet sandwiched between the inner and outer yokes such that a first face of a first magnetic polarity contacts the inner yoke and a second face of a second opposite magnetic polarity contacts the outer yoke, wherein an axially oriented magnet forms part of the magnet assembly, wherein the radially oriented magnet is annular and has opposed axial ends, and the inner and outer yokes are annular and together enclose one axial end of the radially oriented magnet to define the air gap, wherein the outer yoke is generally cylindrical and completely encloses the radially oriented magnet, and wherein the axially oriented magnet is disposed adjacent to the other axial end of the radially oriented magnet, whereby the inner and outer yokes and the axially oriented magnet together reduce flux leakage from the magnet assembly.

2. A magnet assembly according to claim 1, comprising a shield mounted to the axially oriented magnet and to at least one of the inner and outer yokes to provide a path for magnetic flux to flow from the axially oriented magnet to the at least one yoke.

3. A magnet assembly according to claim 2, wherein the axially oriented magnet contacts the inner yoke and wherein the shield contacts the outer yoke.

4. A magnet assembly according to claim 2 or claim 3, wherein the shield is cup shaped.

5. A magnet assembly according to claim 1, claim 2 or claim 3, comprising a second axially oriented magnet mounted at the opposed end of the magnet assembly to the first axially oriented magnet.

6. A magnet assembly according to claim 1, claim 2 or claim 3, wherein the inner yoke has a cross-section which tapers away from the air gap.

7. A magnet assembly according to claim 1, claim 2 or claim 3, wherein the inner and outer yokes are provided with chamfers adjacent the air gap to focus the magnetic field developed within the gap.

8. A magnet assembly according to claim 1, claim 2 or claim 3, wherein the inner yoke and the outer yoke are arranged so that the volume of magnetic flux conductive material in both inner and outer yokes is approximately equal.

9. An actuator comprising a coil assembly, a magnet assembly having inner and outer yokes of magnetic flux conductive material which together define an annular air gap in which the coil assembly is disposed, and a radially oriented magnet sandwiched between the inner and outer yokes such that a first face of a first magnetic polarity is adjacent the inner yoke and a second face of a second opposite magnetic polarity is adjacent the outer yoke, and a suspension connected between the coil assembly and the magnet assembly for supporting the coil assembly for axial movement within the air gap, wherein an axially oriented magnet forms part of the magnet assembly, wherein the radially oriented magnet is annular and has opposed axial ends, and the inner and outer yokes are annular and together enclose one axial end of the radially oriented magnet to define the air gap, wherein the outer yoke is generally cylindrical and completely encloses the radially oriented magnet, and wherein the axially oriented magnet is disposed adjacent to the other axial end of the radially oriented magnet, whereby the inner and outer yokes and the axially oriented magnet together reduce flux leakage from the magnet assembly.

10. A loudspeaker comprising an acoustic radiator and an actuator according to claim 9 which is mounted to the acoustic radiator to drive it to produce an acoustic output.

* * * * *